US008636477B2

(12) United States Patent
Nagasaki et al.

(10) Patent No.: US 8,636,477 B2
(45) Date of Patent: Jan. 28, 2014

(54) CHEMICAL SUPPLY SYSTEM

(75) Inventors: Isao Nagasaki, Komaki (JP); Akihiro Ito, Komaki (JP); Tetsuya Toyoda, Komaki (JP)

(73) Assignee: CKD Corporation, Komaki-shi, Aichi (JP)

( * ) Notice: Subject to any disclaimer, the term of this patent is extended or adjusted under 35 U.S.C. 154(b) by 311 days.

(21) Appl. No.: 13/069,300

(22) Filed: Mar. 22, 2011

(65) Prior Publication Data

US 2011/0240672 A1 Oct. 6, 2011

(30) Foreign Application Priority Data

Mar. 30, 2010 (JP) ..... 2010-078702

(51) Int. Cl.
*F04B 49/00* (2006.01)
*F04B 9/08* (2006.01)
*F04B 35/02* (2006.01)
*F04B 9/12* (2006.01)

(52) U.S. Cl.
USPC ..... 417/46; 417/21; 417/383; 417/384

(58) Field of Classification Search
USPC ..... 417/21, 26, 46, 383, 384, 395
See application file for complete search history.

(56) References Cited

U.S. PATENT DOCUMENTS

| | | | | |
|---|---|---|---|---|
| 7,686,588 | B2 * | 3/2010 | Okumura et al. | 417/21 |
| 7,988,429 | B2 * | 8/2011 | Okumura et al. | 417/395 |
| 2007/0122291 | A1 * | 5/2007 | Okumura et al. | 417/46 |
| 2007/0177998 | A1 * | 8/2007 | Kato | 417/395 |

FOREIGN PATENT DOCUMENTS

JP 2006-46284 2/2006

* cited by examiner

*Primary Examiner* — Peter J Bertheaud
(74) *Attorney, Agent, or Firm* — Beyer Law Group LLP

(57) ABSTRACT

This invention provides a chemical supply system for supplying chemical solution from a chemical tank. The chemical supply system includes a chemical supply pump, a pressure adjuster configured to suction the chemical solution into the pump chamber by setting the pressure of working gas to a suction pressure, a switching controller configured to switch the suction-side opening-closing valve to the open state for starting to fill the pump chamber with the chemical solution, a pressure detector configured to detect at least one of a gas pressure in a space connected to the working chamber and a gas pressure in the working chamber when the suction-side opening-closing valve is switched to the open state and starts an inflow of the chemical solution to the pump chamber, and a suction controller configured to control the suction pressure applied to the working chamber by the pressure adjuster, based on a detection result of the pressure detector.

6 Claims, 7 Drawing Sheets

CHEMICAL SUPPLY SYSTEM

CROSS-REFERENCE TO RELATED APPLICATIONS

This application claims priorities of Japanese Patent Application No. 2010-78702 filed on Mar. 30, 2010 which is hereby incorporated by reference.

BACKGROUND OF THE INVENTION

1. Field of the Invention

The present invention relates to a chemical supply system that supplies a chemical solution by using a chemical supply pump performing suction and discharge of the chemical solution by volume changes inside the pump chamber.

2. Description of the Related Art

In a process using a chemical solution in a semiconductor fabrication apparatus, a chemical supply system such as described in Japanese Patent Application Publication No. 2006-46284 has been suggested for coating a chemical solution such as a photoresist solution in predetermined amounts on a semiconductor wafer.

In the chemical supply system described in Japanese Patent Application Publication No. 2006-46284, a chemical supply pump is provided for sucking the chemical solution contained in a chemical tank and coating the chemical solution that has been sucked in on a semiconductor wafer in predetermined amounts. More specifically, the chemical supply pump has a diaphragm partitioning a pump chamber that is filled with the chemical solution and a working chamber through which working air flows, and is configured such that the air is supplied from a regulator into the working chamber, the diaphragm is deformed toward the pump chamber, and the chemical solution is discharged. Further, a vacuum source is connected to the chemical supply pump, and by supplying a negative pressure from the vacuum source to the chemical supply pump, the volume of the pump chamber is increased and the chemical solution is sucked in.

The level of the chemical solution contained in the chemical tank varies as the chemical solution is discharged and a hydraulic head pressure inside the chemical tank changes accordingly. For example, when the hydraulic head pressure has varied significantly, the suction time during suction of the chemical solution into the chemical supply pump varies significantly. As a result, the time required to suck the chemical solution into the chemical supply pump can change significantly.

In order to resolve this problem, a configuration can be considered in which a liquid level sensor or a weight sensor is provided in the chemical tank, the variation of hydraulic head pressure is directly detected, and the suction operation in the chemical supply pump is controlled according to the detection result. However, in such a configuration, the system should be changed on both the chemical tank side and the chemical supply pump side, and the number of changes required for the already existing systems is large.

Further, a configuration can be also considered in which a needle valve is provided at a position on the chemical tank side, rather than the chemical supply pump side, a throttle amount is manually adjusted, and the effect of hydraulic head pressure is reduced, but in this case the effect of hydraulic head pressure cannot be reduced automatically.

SUMMARY OF THE INVENTION

Accordingly, an object of the present invention is to solve at least a part of the conventional problems described above with a technique for reducing the effect of hydraulic head pressure in a chemical supply system.

The above and other objects of the present invention are attained at least partly by a chemical supply system for supplying chemical solution provided from a chemical tank. The chemical supply system includes: a chemical supply pump having a pump chamber and a working chamber, the pump chamber being configured to be loaded with chemical solution from the chemical tank, the working chamber being configured to be loaded with working gas, the pump chamber and the working chamber commonly having a volume-changing member configured to actuate the pump chamber to suction and discharge the chemical solution, the volume-changing member being actuated in response to a pressure of the working gas loaded in the working chamber; a pressure adjuster configured to suction the chemical solution into the pump chamber by setting the pressure of working gas to a suction pressure; a switching controller having a discharge-side opening-closing valve provided in a discharge passage connected to the pump chamber, a suction-side opening-closing valve provided in a suction passage connected to the pump chamber, wherein the switching controller is configured to switch the suction-side opening-closing valve to the open state for starting to fill the pump chamber with the chemical solution when the suction-side opening-closing valve and the discharge-side opening-closing valve are in closed state; a pressure detector configured to detect at least one of a gas pressure in a space connected to the working chamber and a gas pressure in the working chamber when the suction-side opening-closing valve is set to the open state and starts an inflow of the chemical solution to the pump chamber; and a suction controller configured to control the suction pressure applied to the working chamber by the pressure adjuster, based on a detection result of the pressure detector.

With this configuration, the suction pressure applied by the pressure adjuster to the working chamber is controlled on the basis of the detection result of the pressure detector in the open state of the suction-side opening-closing valve. Therefore, the suction pressure can be applied by taking the hydraulic head pressure of the chemical tank into account. Further, since the pressure detector detects the gas pressure inside a space communicating with the working chamber or inside the working chamber, no changes in configuration are required upstream or downstream of the chemical supply pump in the flow channel path of the chemical solution. Further, since a configuration is used in which the set value of suction pressure is determined on the basis of the detection result in the pressure detector when the suction-side opening-closing valve is in the open state, the above-described control can be performed in conformity with the process in which suction of the chemical solution is performed.

These and other object, features, aspects and advantages of the present invention will become more apparent from the following detailed description of the preferred embodiments with the accompanying drawings.

DESCRIPTION OF THE PREFERRED EMBODIMENTS

A. First Embodiment

The first embodiment of the present invention will be described below with reference to the appended drawings. The present embodiment relates to a chemical supply system that is used in a production line of semiconductor devices or the like. The basic configuration of the system will be explained below with reference to FIG. 1.

Figure 1:
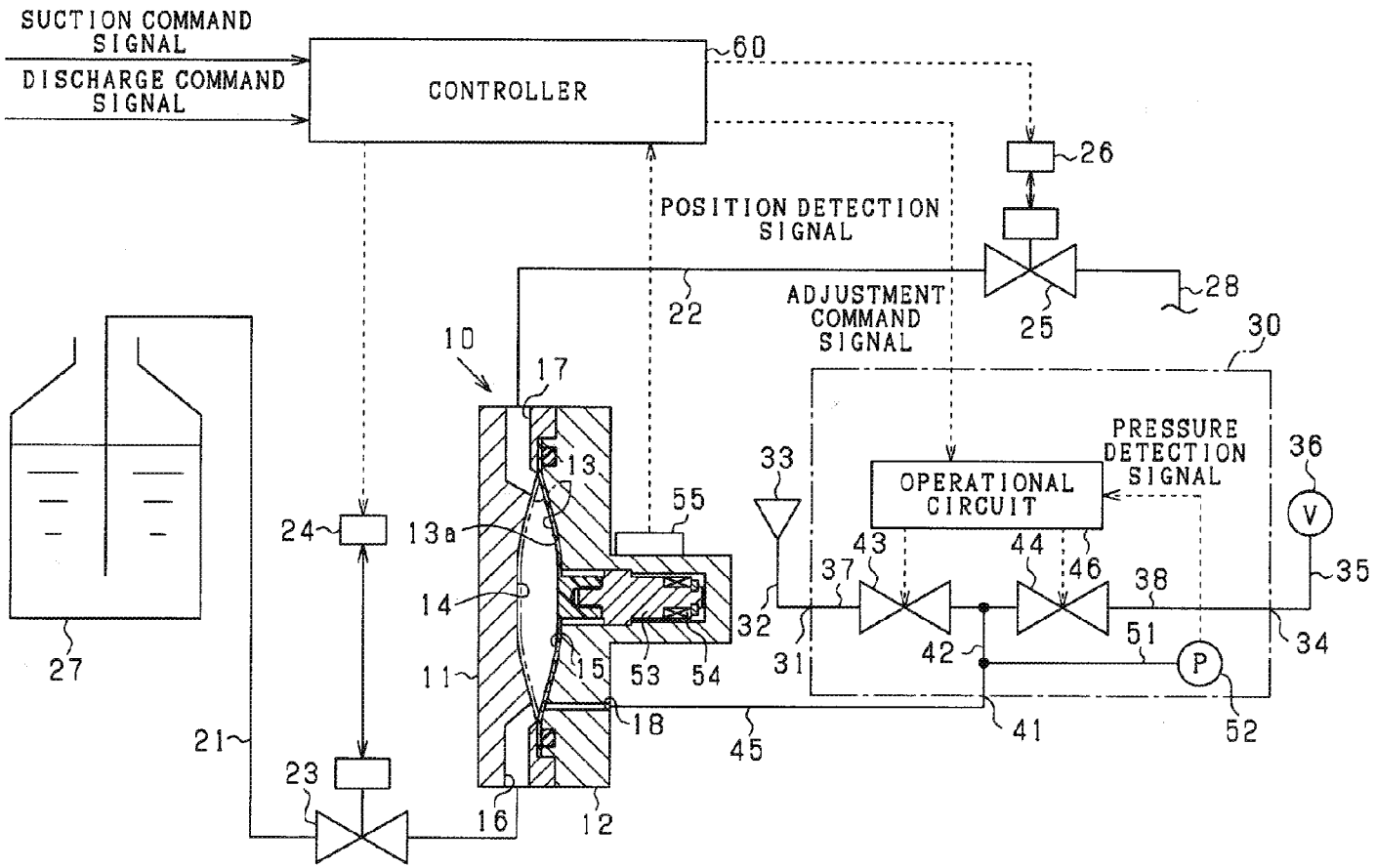
FIG. 1 is a configuration diagram illustrating schematically the chemical supply system of the first embodiment.

The chemical supply system shown in FIG. 1 includes a chemical supply pump 10 for sucking in and discharging a chemical solution. The chemical supply pump 10 has two (left and right) divided bodies 11, 12, and recesses are formed in opposing surfaces of these bodies 11, 12. A diaphragm 13 composed of a flexible film is inserted as a volume-changing member between the bodies 11, 12, and the circumferential edge of the diaphragm 13 is clamped by the bodies 11, 12. In this case, the space in the recesses of the bodies 11, 12 is partitioned by a partition region 13*a* of the diaphragm 13, a pump chamber 14 is formed between the recess of one body 11 and the partition region 13*a*, and a working chamber 15 is formed between the recess of the other body 12 and the partition region 13*a*.

A suction port 16 and a discharge port 17 linked to the pump chamber 14 are formed in the body 11, a suction pipe 21 is connected to the suction port 16, and a discharge pipe 22 is connected to the discharge port 17. A suction valve 23, which is a suction-side opening-closing valve, is provided in the suction pipe 21, and the suction valve 23 is opened and closed according to the energizing state of an electromagnetic valve 24. Further, a discharge valve 25, which is a discharge-side opening-closing valve, is provided in the discharge pipe 22, and the discharge valve 25 is opened and closed according to the energizing state of an electromagnetic valve 26. For example, the intake valve 23 and discharge valve 25 are configured by air-operated valves that are opened and closed by air pressure. The air pressure acting upon the valves 23, 25 is adjusted according to the energizing state of the electromagnetic valves 24, 26 and the valves 23, 25 are opened and closed accordingly.

The suction pipe 21 constitutes a suction passage for supplying a chemical solution such as a resist solution toward the pump chamber 14, and the chemical solution stored in a chemical tank 27 is supplied to the pump chamber 14 via the suction pipe 21. As a result, the interior of the pump chamber 14 is filled with the chemical solution. In this case, the hydraulic head pressure of the chemical solution flowing from the chemical tank 27 toward the pump chamber 14 changes according to the amount of the chemical solution stored inside the chemical tank 27. Further, the discharge pipe 22 constitutes the discharge passage for discharging the chemical solution loaded into the pump chamber 14, and the chemical solution discharged from the pump chamber 14 is supplied to a chemical solution discharge nozzle 28 via the discharge pipe 22.

A supply-discharge port 18 communicating with the working chamber 15 is formed in the other body 12, and an electropneumatic regulator 30 provided as a pressure regulator is connected to the supply-discharge port 18. The electropneumatic regulator 30 constitutes a positive pressure supply unit for supplying a positive pressure and a negative pressure supply unit for supplying a negative pressure into the working chamber 15.

More specifically, an intake port 31 of the electropneumatic regulator 30 is connected to a supply source via a supply pipe 32, and a discharge port 34 of the electropneumatic regulator 30 is connected via a discharge pipe 35 to a vacuum generating source 36 serving as a negative pressure generating source. In the electropneumatic regulator 30, an intake passage 37 leading from the intake port 31 communicates, via an intake electromagnetic valve 43 serving as a first opening-closing valve, with an output passage 42 leading to an output port 41 of the electropneumatic regulator 30. Further, a discharge passage 38 leading from the discharge port 34 in the electropneumatic regulator 30 communicates with the output passage 42 via a discharge electromagnetic valve 44 serving as a second opening-closing valve.

Opening and closing of the intake electromagnetic valve 43 and the discharge electromagnetic valve 44 are controlled by an operational circuit 46 provided in the electropneumatic regulator 30. Where the intake electromagnetic valve 43 is in the open state, the working air compressed in the supply source 33 is supplied to the working chamber 15 of the chemical supply pump 10 via the output port 41, thereby applying a positive pressure as a discharge pressure to the working chamber 15. Where the discharge electromagnetic valve is in the open state, a negative pressure serving as an intake pressure is applied to the working chamber 15 via the output port 41 and the working air of the working chamber 15 is sucked in.

With the above-described configuration, in a state in which a negative pressure is applied inside the working chamber 15, the partition region 13*a* of the diaphragm 13 is deflected toward the recess in the working chamber 15 side. As a result, the volume inside the pump chamber 14 increases. When such deflection deformation is induced, the suction valve is opened and the discharge valve 25 is closed. As a result, the chemical solution is sucked into the pump chamber 14 via the suction pipe 21.

In a state in which a positive pressure is applied inside the working chamber 15, the partition region 13*a* of the diaphragm 13 is deflected toward the recess in the pump chamber 14 side (position shown by a two-dot-dash line in FIG. 1). As a result, the volume of the pump chamber 14 decreases. When such deflection deformation is induced, the suction valve is closed and the discharge valve 25 is opened. As a result, the chemical solution located inside the pump chamber 14 is discharged via the discharge pipe 22.

The output passage 42 is provided with a detection passage 51 branched off the output passage 42, and a pressure sensor 52 serving as a pressure detector is provided in the detection passage 51. The air pressure inside the output passage 42 is detected by the pressure sensor 52, and the pressure detection signal is outputted to the operational circuit 46. Further, the operational circuit 46 inputs an adjustment command signal including information of a set pressure command from the below-described controller 60. The operational circuit 46 controls the time intervals in which the supply electromagnetic valve 43 and the discharge electromagnetic valve 44 are in the open state so that the pressure of the working air in the output passage 42 becomes equal to the pressure corresponding to the set pressure of the adjustment command signal on the basis of the set pressure read from the adjustment command signal and the actual pressure determined from the abovementioned pressure detection signal. As a result, the pressure of the working air inside the output port 41 is adjusted to the set pressure.

A rod 53 having a substantially round columnar shape is accommodated in the body 12 in which the supply-discharge port 18 is provided in the chemical supply pump 10. The rod 53 is connected at one end to the partition region 13*a* of the diaphragm 13 and mounted at the other end on a sensor magnet 54. A position detection sensor 55 that can detect magnetism of the sensor magnet 54 is attached as a position detector to the body 12. The position detection sensor 55 detects variations in the magnetic field generated by the sensor magnet 54 as the rod 53 moves, and the position detection sensor outputs to the controller 60 a position detection signal corresponding to the position of the rod 53, that is, the position of the partition region 13*a*. The controller 60 is also referred to as a chemical supply control system.

The controller 60 is an electronic control unit constituted mainly by a microcomputer composed of a CPU and various memory devices with programs installed. The controller controls the suction and discharge of the chemical solution by the chemical supply pump 10. The controller 60 inputs a suction command signal and a discharge command signal from an administration computer (not shown in the figure) that administers the entire present system and also the position detection signal from the position detection sensor 55. The controller 60 also controls the open-closed state of the suction pump 23 and discharge pump 25 as the energized and non-energized states of the electromagnetic valves 24, 26 on the basis of the inputted signals. Further, the controller outputs the adjustment command signal to the electropneumatic regulator 30 and controls the state of the electropneumatic regulator 30. In particular, in this case, the controller 60 controls the state of the electropneumatic regulator 30 so that the time interval required for suction of the chemical solution in the chemical supply pump 10 maintains a constant value and does not depend on the hydraulic head pressure of the chemical tank 27.

Figure 2:
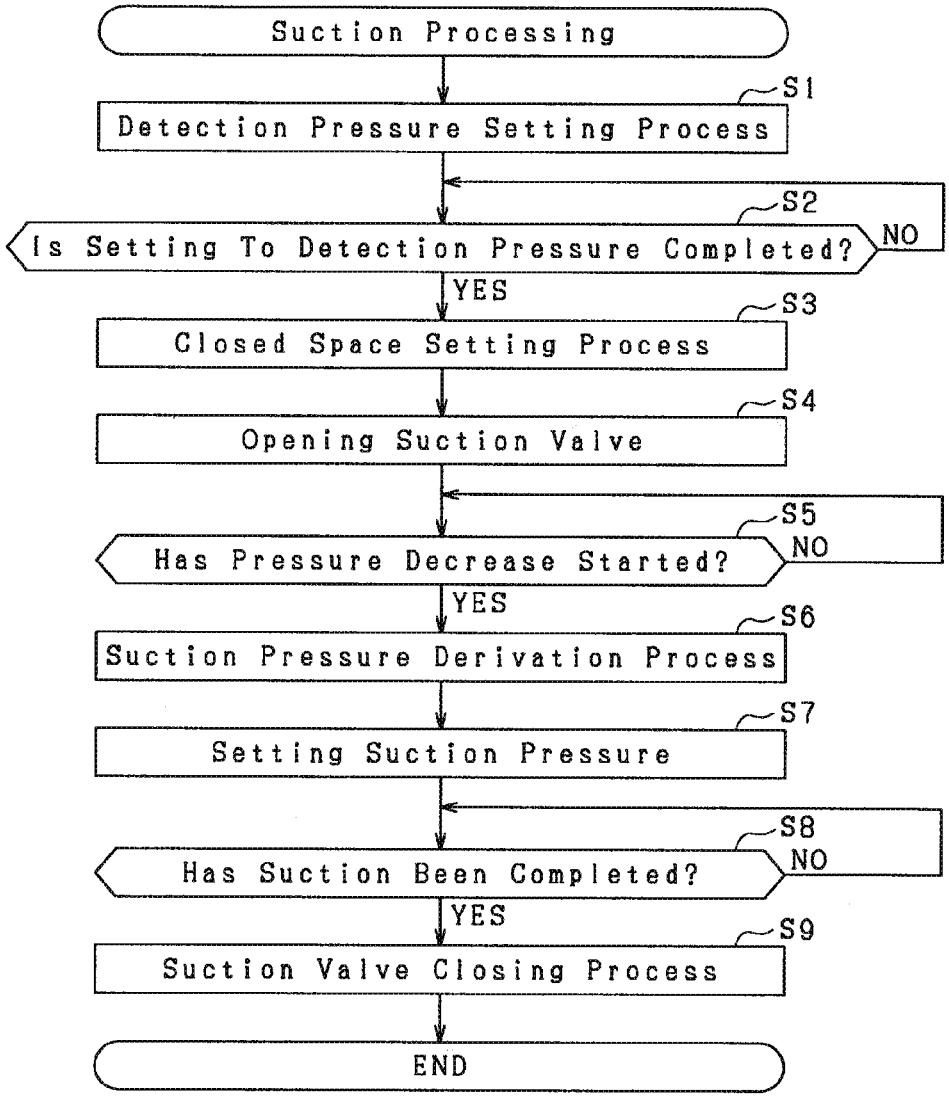
FIG. 2 is a flowchart illustrating the suction processing in the first embodiment.

The contents of suction processing executed by the controller 60 will be explained below with reference to the flowchart shown in FIG. 2. The suction processing is started when a suction command signal is inputted from the administration computer to the controller 60. Further, in the explanation below, the operation resulting from the execution of suction processing will be also explained, while referring to FIG. 3 showing a time chart illustrating how the pressure detected by the pressure sensor 52 changes with time.

In step S1, the pressure setting processing for detection is executed. In the pressure setting processing for detection, a set pressure for making the pressure applied to the chemical supply pump 10 equal to the detection pressure is indicated to the electropneumatic regulator 30 so that the hydraulic head pressure of the chemical tank 27 could be estimated by using the detection results of the pressure sensor 52 of the electropneumatic regulator 30. This detection pressure is preferably less than the minimum pressure that can be assumed for the hydraulic head pressure. More specifically, the detection pressure is the atmospheric pressure, and in step S1, an adjustment command signal for making the pressure of the working chamber 15 equal to the atmospheric pressure is outputted to the operational circuit 46. In step S2, the processing waits till the pressure detection signal from the pressure sensor 52 becomes a signal corresponding to the atmospheric pressure.

Figure 3:
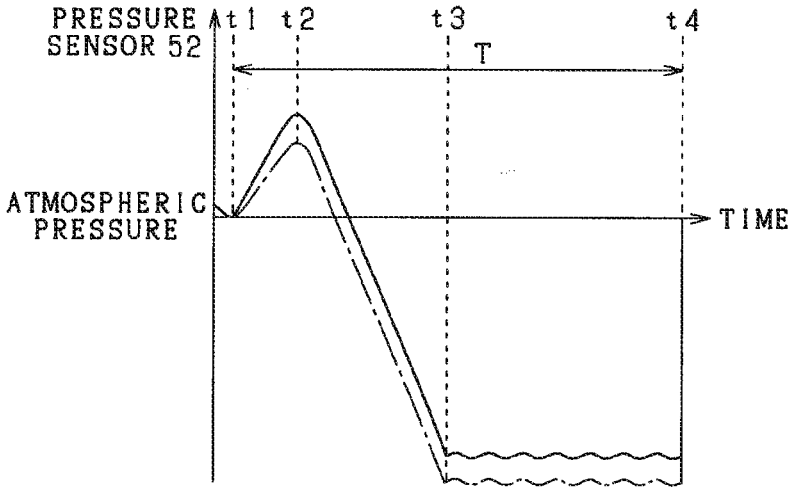
FIG. 3 is a time chart showing how the time required for suction in the first embodiment becomes constant.

When the detection result of the pressure sensor 52 becomes the atmospheric pressure, as shown at a timing t1 in FIG. 3, the closed space setting processing is executed in step S3. More specifically, an adjustment command signal that instructs both the supply electromagnetic valve 43 and the discharge electromagnetic valve 44 to assume the closed state is outputted to the operational circuit 46. As a result, not only the working chamber 15 of the chemical supply pump 10, but also the air pipe 45 and output passage 42 communicating with the working chamber 15 become closed spaces. In other words, the spaces that communicate with the working air and the interior of the working chamber 15 become closed spaces.

Then, in step S4, the suction valve 23 is open. Thus, the partition region 13*a* of the diaphragm 13 is positioned close to the recess on the pump chamber 14 side immediately before the suction valve 23 is set to the open state.

Since the suction valve 23 is set to the open state, the chemical solution located inside the suction pipe 21 is pushed by the hydraulic head pressure of the reaction solution tank 27 and flows into the pump chamber 14 of the chemical supply pump 10 even when the interior of the working chamber 15 of the reaction solution supply pump 10 is under a substantially atmospheric pressure. In this case, the working air inside the working chamber 15 is pushed to the electropneumatic regulator 30 side and therefore the pressure detected by the pressure sensor 52 rises as shown in the t1 to t2 period in FIG. 3. Then, at a timing t2, the pressure detected by the pressure sensor 52 assumes a maximum value (peak value on the positive pressure side). The detected pressure that has assumed the maximum value corresponds to the present hydraulic head pressure.

In the suction processing (FIG. 2), after the suction valve 23 has been set to the open state in step S4, the system stands by in step S5 till the pressure detected by the pressure sensor 52 starts decreasing. After the detected pressure has started decreasing, a suction pressure derivation processing is performed in step S6.

In the suction pressure derivation processing, the pressure detected by the pressure sensor 52 at the present point of time is used as an estimated hydraulic head pressure and a set value of suction pressure in the present suction operation, more specifically a set value of negative pressure is derived. Thus, a data table in which set values of negative pressure are set correspondingly to the pressure detected by the pressure sensor 52 is stored in advance and a set value of negative pressure corresponding to the detected pressure that is presently acquired is read from the data table. However, such a configuration is not limiting and it is also possible to store in advance a reference set pressure correspondingly to a reference estimated value of hydraulic head pressure and calculate a set value of negative pressure by correcting the ratio of the pressure detected by the pressure sensor 52 and the reference estimated pressure according to the reference set pressure. The set value of suction pressure derived in step S6 is any pressure within a pressure range for suction (that is, a range of negative pressure) that can be set in the electropneumatic regulator 30.

Information on the set value of suction pressure derived in step S6 is outputted in step S7 as an adjustment command signal to the operational circuit 46. As a result, in the operational circuit 46, the negative pressure applied to the working chamber 15 is adjusted to obtain this set value of negative pressure. More specifically, the operational circuit 46 controls the discharge electromagnetic valve 44 so that a negative pressure is gradually applied toward this set value as shown in the t2 to t3 period in FIG. 3 and then controls the discharge electromagnetic valve 44 so that the applied negative pressure is generally maintained at the set pressure level as shown in the t3 to t4 period.

In this case, the set value of suction pressure derived in the above-described derivation processing is set such that the difference between a hydraulic head pressure and an actual suction pressure applied from the pump chamber 14 to the suction pipe 21 side is constant or substantially constant, regardless of the estimated value of the hydraulic head pressure. More specifically, the set value of suction pressure derived in the above-described derivation processing is set such that the time required for the position of the partition region 13*a* of the diaphragm 13 to assume the position corresponding to completion of suction is constant or substantially constant, regardless of the estimated value of the hydraulic head pressure.

Explaining in greater detail, the suction pressure derived in the above-described derivation processing is such that the acceleration required for the displacement speed of the partition region 13*a* to become substantially constant and the time required for the transient period thereof (t2 to t3 period in FIG. 3) are constant or substantially constant, regardless of the estimated value of the hydraulic head pressure, and the displacement speed attained when the displacement speed of the partition region 13*a* became substantially constant is constant or substantially constant, regardless of the estimated value of the hydraulic head pressure. Where the suction pressure is thus set, the set value of the suction pressure is lower when the estimated value of the hydraulic head pressure is low, as shown by a dot-dash line in FIG. 3, than when the estimated value of the hydraulic head pressure is high, as shown by a solid line. As a result, the time required to suck in the chemical solution takes a constant value T even if the hydraulic head pressure of the chemical tank 27 changes.

In the suction processing (FIG. 2), after the processing of step S7 has been executed, the system stands by in step S8 till the suction of the chemical solution is completed. More specifically, the system stands by till the partition region 13*a* assumes a predetermined position close to the recess on the working chamber 15 side, more specifically the position that has been determined in advance and corresponds to the suction amount taking a predetermined value, on the basis of the detection result of the position detection sensor 55. When suction of the chemical solution is completed, the suction valve 23 is set to the closed state in step S9 and the present suction processing is ended.

With the embodiment described in detail above, the following excellent effects can be obtained.

Where the hydraulic head pressure decreases, a force pushing the chemical solution from the chemical tank 27 side to the chemical supply pump 10 is weakened. Therefore where the suction pressure applied to the working chamber 15 is constant, the time required to complete the suction of chemical solution increases with the transition to the subsequent suction operation and the time required for suction of the chemical solution changes. To solve this problem, when suction of the chemical solution is started, the hydraulic head pressure is initially estimated and the suction pressure is set on the basis of the estimated hydraulic head pressure so that the displacement rate of the partition region 13*a* becomes constant in all of the suction operations. As a result, the time required for suction can be automatically made constant.

Further, in this configuration, the pressure applied to the working chamber 15 to detect the effect of hydraulic head pressure is set to the detection pressure on the atmospheric side of the suction pressure, more specifically to the atmospheric pressure, then the pump chamber 14 is started to be filled with the chemical solution in the atmospheric pressure thus set, and a suction pressure in the present suction operation is determined based on the detection result of pressure in the pressure sensor 52 at this time. As a result, the effect of hydraulic head pressure can be read more directly and the setting of suction pressure corresponding to changes in the hydraulic head pressure can be performed more effectively than with the configuration in which the effect of hydraulic head pressure is detected when a suction pressure is actively applied to the chemical supply pump 10.

In the present configuration, the above-described setting of detection pressure is performed in the circumstances in which the suction valve 23 is in the closed state after the chemical solution discharge operation has been performed, and a set value of suction pressure is determined on the basis of the detection result of the pressure sensor 52 in a state in which the suction valve 23 that should start the reaction solution suction operation has been set to the open state. Therefore, the set value of suction pressure can be determined, while conforming to the suction process of the chemical solution performed in the chemical supply pump 10.

Within the period in which the detection result of the pressure sensor 52 is acquired to estimate the hydraulic head pressure, the supply electromagnetic valve 43 and the discharge electromagnetic supply 44 are both maintained in the closed state and the working chamber 15 and the space communicating with the working chamber 15 are closed spaces. As a result, the effect of hydraulic head pressure can be directly read and a suction pressure conforming to changes in the hydraulic head pressure can be effectively set.

Such direct reading of the effect of hydraulic head pressure can be realized also because the suction pressure is set on the basis of the detection result in the pressure sensor 52. In particular, since the pressure sensor 52 is used to perform feedback control of actual pressure to the set pressure in the operational circuit 46, setting the suction pressure by using the pressure sensor 52 makes it possible to minimize changes in hardware configuration required for application to the existing chemical supply system.

It is also possible to provide an electropneumatic-side controller instead of the operational circuit 46 of the electropneumatic regulator 30 and perform the detection pressure setting processing or suction pressure derivation processing after the suction processing in the electropneumatic-side controller.

B. Second Embodiment

In the present embodiment, the configuration used to eliminate the effect of hydraulic head pressure of the chemical tank 27 in the chemical solution suction operation is different from that of the first embodiment. The difference between the two configurations will be described below.

The chemical supply system of the present embodiment is basically similar to that shown in FIG. 1. However, when a set value of suction pressure is determined, a detection result of the position detection sensor 55 is used instead of a detection result of the pressure sensor 52.

Figure 4:
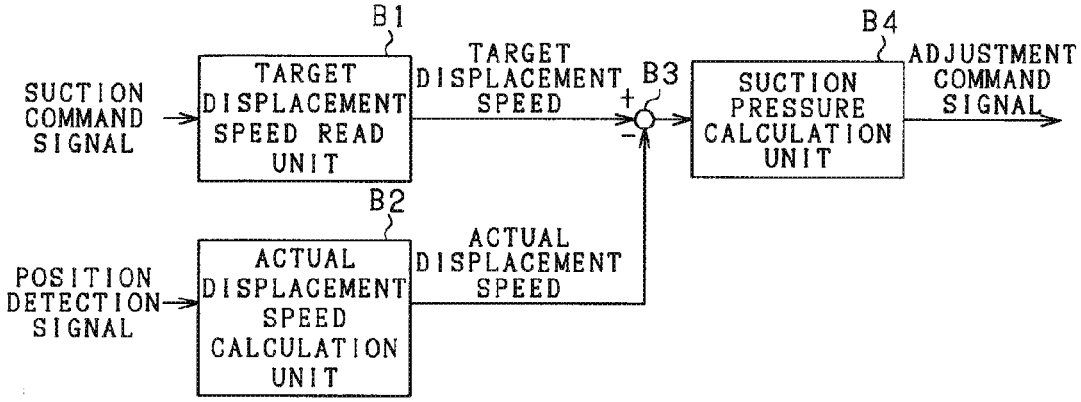
FIG. 4 is a block-diagram illustrating the operational processing during suction of the chemical solution in the second embodiment.

FIG. 4 shows the contents of computations performed in the controller 60 during suction of the chemical solution. The below-described operational processing is performed repeatedly with comparatively short intervals during suction of the chemical solution.

A target displacement rate read unit B1 reads from a nonvolatile memory of the controller 60 a target value of displacement rate in the case in which the partition region 13*a* of the diaphragm 13 is displaced on the basis of a suction command from the administration computer. In another possible configuration, the target displacement rate is stored in a plurality of patterns and a command indicating which target displacement rate to use is executed on the basis of the suction command signal.

An actual displacement rate computation unit B2 stores the history of position of the partition region 13*a* for each case on the basis of position detection signals from the position detection sensor 55 and calculates a displacement amount of the partition region 13*a* from the information contained in the history. The actual displacement rate of the partition region 13*a* is calculated by taking the derivative of the calculated displacement amount with respect to time.

A difference calculation unit B3 calculates a difference between the target displacement rate and the actual displacement rate. A suction pressure calculation unit B4 calculates information on the set value of suction pressure which is an operation amount for suction that is required for feedback control of the actual displacement rate to the target displacement rate. The calculated information on the set value of suction pressure is outputted as an adjustment command signal to the operational circuit 46 of the electropneumatic regulator 30. In the operational circuit 46, the discharge electromagnetic valve 44 is controlled on the basis of the adjustment command signal, and the actual displacement rate of the partition region 13*a* is made equal to the target displacement rate.

In this case, in the controller 60, the discharge operation is started as the chemical solution suction operation ends in the case in which it is detected that the partition region 13*a* has assumed a predetermined position close to the recess on the working chamber 15 side, more specifically the position that has been determined in advance and corresponds to the suction amount taking a predetermined value, on the basis of the detection result of the position detection sensor 55. In this case, since the actual displacement rate of the partition region 13*a* is made equal to the target displacement rate, as described hereinabove, a constant time is required for suction of the chemical solution.

The output of the adjustment command signal that took part in the above-described feedback control is repeated a plurality of times within one suction operation. Further, the target displacement rate read unit B1, actual displacement rate calculation unit B2, difference calculation unit B3, and suction pressure calculation unit B4 correspond to the negative pressure controller in the present embodiment.

Figure 5:
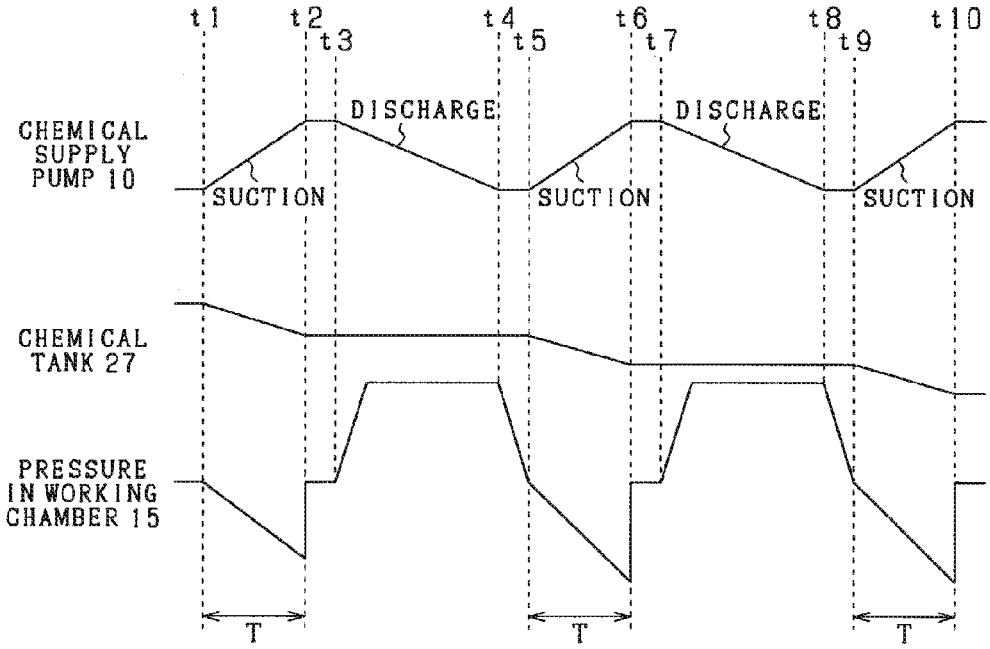
FIG. 5 is a time chart showing how the time required for suction in the second embodiment becomes constant.

A process of obtaining a constant time required for suction will be explained below with reference to the time chart shown in FIG. 5. FIG. 5 illustrates the operation state of the chemical supply pump 10, the hydraulic head pressure of the chemical tank 27, and a pressure applied in the working chamber 15 of the chemical supply pump 10.

Where the chemical supply system is set to the ON state at a timing t1, the chemical supply pump 10 alternately performs the chemical solution suction operation and chemical solution discharge operation. In this case, in the t3 to t4 period and t7 to t8 period, a positive pressure is applied to the working chamber 15 to perform the discharge operation, but in the t4 to t5 period and t8 to t9 period, which are transient periods relating to switching from the discharge operation to the suction operation, the pressure is gradually reduced to prevent the occurrence of an abrupt pressure drop when the suction operation is started. At a timing at which the suction operation is started, the working chamber 15 is under the atmospheric pressure. At this timing, the partition region 13*a* of the diaphragm 13 is naturally positioned close to the recess on the pump chamber 14 side.

The chemical solution suction operation is performed in the t1 to t2 period, t5 to t6 period, and t9 to t10 period, and since the chemical solution amount in the chemical tank 27 decreases each time the suction operation is performed, the hydraulic head pressure of the chemical tank 27 also decreases. Where the hydraulic head pressure decreases, a force pushing the chemical solution from the chemical tank 27 side to the chemical supply pump 10 is weakened. To solve this problem, as has already been explained hereinabove, the set value of the suction pressure is adjusted so that the displacement rate of the partition region 13*a* becomes constant by a feedback control that is based on the process of detecting the position of the partition region 13*a* of the diaphragm 13 with the position detection sensor 55. Therefore, the suction pressure applied to the working chamber 15 decreases to the negative pressure side with the transition to the subsequent suction operation. In other words, the difference between the hydraulic head pressure and the actual suction pressure applied from the pump chamber 14 to the suction pipe 21 side becomes constant or substantially constant. As a result, the suction operations require a constant time T.

With the embodiment described in detail above, the following excellent effects can be obtained.

Where the hydraulic head pressure decreases, a force pushing the chemical solution from the chemical tank 27 side to the chemical supply pump 10 is weakened. Therefore, where the suction pressure applied to the working chamber 15 is constant, the time required to complete the suction of chemical solution increases with the transition to the subsequent suction operation and the time require for suction changes. To solve this problem, the position of the partition region 13*a* of the diaphragm 13 in the suction operation is detected with the position detection sensor 55 and the set value of the suction pressure is adjusted on the basis of the detection result of the position detection sensor 55 so that the displacement rate of the partition region 13*a* becomes constant. As a result, the time required for suction can be automatically made constant.

The adjustment command signal corresponding to the difference between the actual displacement rate based on the detection result of the position detection sensor 55 and the target displacement rate that has been determined in advance is repeatedly outputted during the suction operation. Therefore, the set value of the suction pressure can be easily caused to trace the variation of hydraulic head pressure of the chemical tank 27 and the tracing by the set value of the suction pressure can be performed during the suction operation.

The position detection sensor 55 is used to specify in the controller 60 whether the position of the partition region 13*a* is a position at which suction of the chemical solution has been completed, that is, where the suction operation has been completed. Therefore, setting the suction pressure by using the position detection sensor 55 makes it possible to minimize changes in hardware configuration required for application to the existing chemical supply systems.

C. Third Embodiment

In the present embodiment, the configuration used to eliminate the effect of hydraulic head pressure of the chemical tank 27 in the chemical solution suction operation is different from that of the first embodiment. The difference between the two configurations will be described below.

The chemical supply system of the present embodiment is basically similar to that shown in FIG. 1. However, the detection results of the pressure sensor 52 are not used to determine the set value of suction pressure and the configuration of the electropneumatic regulator 30 is different from that described above.

Figure 6:
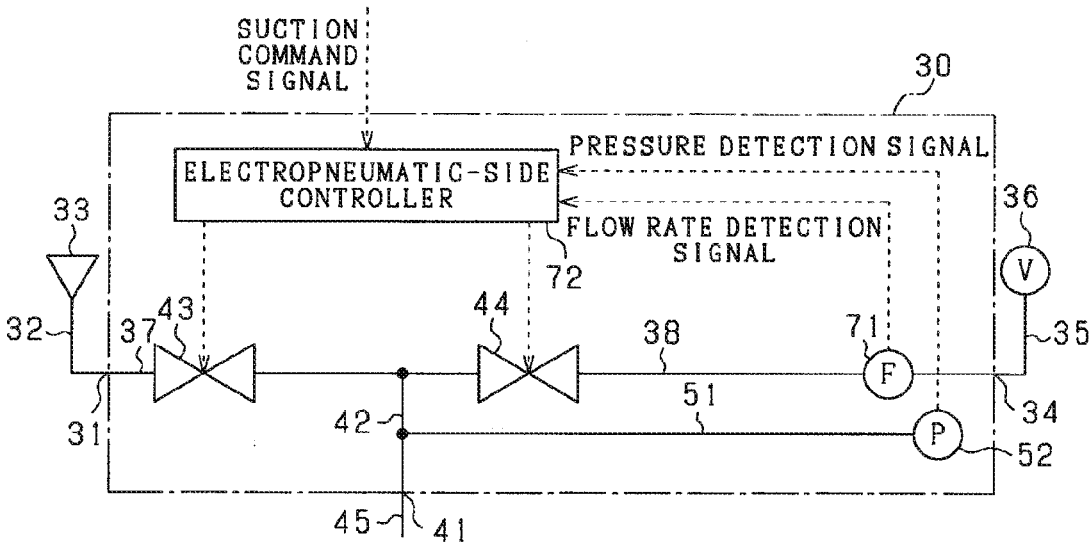
FIG. 6 is an explanatory drawing illustrating the circuit relating to a electropneumatic regulator in the third embodiment.

More specifically, as shown in FIG. 6, a flow rate sensor 71 is provided in the intermediate position of the discharge passage 38 of the electropneumatic regulator 30. Since the flow rate sensor 71 is provided, it is possible to detect the flow rate of the working air when the suction pressure is applied to the working chamber 15 of the chemical supply pump 10 and the working air of the working chamber 15 is sucked in and, as a result, it is possible to understand volume changes in the working chamber 15 when the suction pressure is applied thereto. Further, in the electropneumatic regulator 30, an electropneumatic-side controller 72 constituted on the basis of a microcomputer including a CPU and memories of various kinds is provided instead of the operational circuit 46, and the detection result of the flow rate sensor 71 is inputted as a flow rate detection signal to the electropneumatic-side controller 72. In the electropneumatic-side controller 72, a set value of suction pressure during a suction operation is determined on the basis of a suction command signal inputted from the system-side controller 60.

Figure 7:
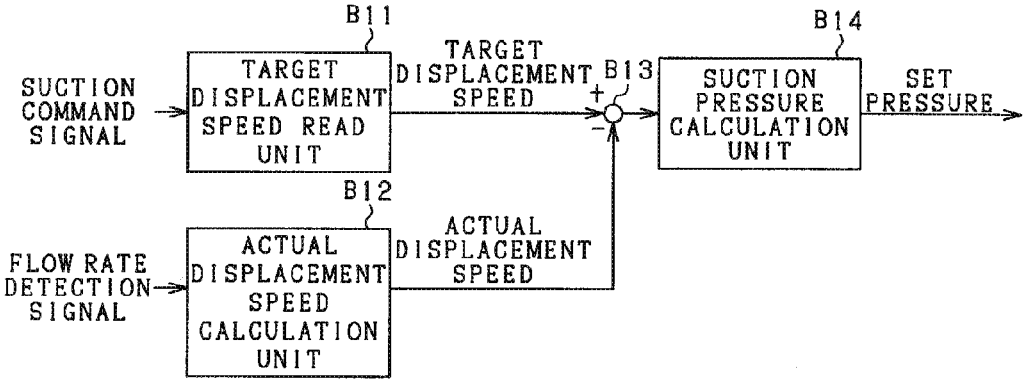
FIG. 7 is a block-diagram illustrating the operational processing during suction of the chemical solution in the third embodiment.

FIG. 7 is a block-diagram illustrating the contents of computations performed in the electropneumatic-side controller 72 during suction of the chemical solution.

A target displacement rate read unit B11 reads a target displacement rate in the same manner as the target displacement rate read unit B1 in the second embodiment. An actual displacement rate computation unit B12 calculates a displacement amount of the partition region 13*a* of the diaphragm 13 on the basis of the flow rate detection signal from the flow rate sensor 71. The actual displacement rate of the partition region 13*a* is calculated by taking the derivative of the calculated displacement amount with respect to time.

A difference calculation unit B13 calculates a difference between the target displacement rate and the actual displacement rate. A suction pressure calculation unit B14 calculates information on the set value of suction pressure, which is an operation amount for suction that is required for feedback control of the actual displacement rate to the target displacement rate. Further, the discharge electromagnetic valve 44 is controlled on the basis of the calculated set pressure, and the actual displacement rate of the partition region 13*a* is made equal to the target displacement rate. As a result, the time required for suction is made constant.

In the above-described embodiment, the effect of hydraulic head pressure of the chemical tank 27 is also prevented and the time required for suction can be made constant in the same manner as in the above-described first embodiment. This result is obtained by changing the configuration of the electropneumatic regulator 30.

D. Other Typical Configurations

The chemical supply system according to the second aspect of the invention is the chemical supply system according to the first aspect of the invention in the summary. The suction controller is configured to set a lower set value of the suction pressure after the detection, a lower pressure being detected by the pressure detector.

With such a configuration, where the hydraulic head pressure is low, the set value of suction pressure also becomes low. Therefore, even when the hydraulic head pressure deceases, it is possible to prevent the extreme increase in the time interval required for suction of the chemical solution. In other words, since the control is performed such that the difference between the hydraulic head pressure and the actual suction pressure applied from the pump chamber to the suction passage is constant or substantially constant even if the hydraulic head pressure changes, it is possible to prevent the extreme increase in the time interval required for suction of the chemical solution.

The chemical supply system according to the third aspect of the invention is the chemical supply system according to the first or second aspect of the invention, further including a position detector configured to detect a position of the volume-changing member. The switching controller is configured to control the suction-side opening-closing valve to switch from the open state to the closed state in response to a detection result of the position detector corresponding to a complete position of the volume-changing member, the complete position being for the volume-changing member to complete the suction, and the suction controller is configured to control the suction pressure applied to the working chamber by the pressure adjuster, for obtaining a constant time required for the position of the volume-changing member to move to the complete position in each suction operation.

Determining whether the suction operation has been completed on the basis of the detection result of the position detector makes it unnecessary to measure the time for determining the completion of suction operation. In this case, the set value of suction pressure is determined according to the hydraulic head pressure of the chemical tank and controlled so that the time required for the position of the volume-changing member to assume a position corresponding to completion of suction in each suction operation becomes constant. As a result, in the configuration in which whether a suction operation has been completed is determined on the basis of position detection as described hereinabove, the same suction operation time can be obtained in each cycle.

The chemical supply system according to the fourth aspect of the invention is the chemical supply system according to any one of the first to third aspects of the invention. The pressure adjuster includes: a first opening-closing valve configured to control on-off of the application of a discharge pressure to the working chamber; and a second opening-closing valve configured to control on-off of the application of the suction pressure to the working chamber. The pressure adjuster is configured to close the first opening-closing valve and the second opening-closing valve, whereby the working chamber and a space connected with the working chamber are made closed spaces, till the detection of pressure by the pressure detector is completed, for the pressure adjuster to determine a set value of the suction pressure by the suction controller.

With such a configuration, when the suction-side opening-closing valve is in the closed state in the circumstances in which the detection pressure is set, the changes in the gas pressure inside the working chamber can be directly detected.

The chemical supply system according to the fifth aspect of the invention is the chemical supply system according to any one of the first to fourth aspects of the invention, further including a detection controller configured to set a pressure of the pressure adjuster to a detection pressure, the detection pressure being for enabling the pressure detector to detect changes in pressure caused by a flow of the chemical solution into the pump chamber, the flow being made by the opening of the suction-side opening-closing valve when the discharge-side opening-closing valve and the suction-side opening-closing valve are in the closed state. The suction controller is configured to control the suction pressure applied to the working chamber by the pressure adjuster based on a detection result of the pressure detector, the detection result being obtained when a flow of the chemical solution started by opening the suction-side opening-closing valve, wherein the pressure is set to the detection pressure before the opening of the suction-side opening-closing valve.

As a result, the effect of hydraulic head pressure can be read more directly and setting of suction pressure corresponding to changes in the hydraulic head pressure can be performed more effectively than with the configuration in which the effect of hydraulic head pressure is detected in the case in which a suction pressure is actively applied to the chemical supply pump.

The chemical supply system according to the sixth aspect of the invention is the chemical supply system according to the fifth aspect of the invention. The detection pressure is such that the chemical solution flows into the pump tank under a hydraulic head pressure of the chemical tank when the suction-side opening-closing valve is switched to the open state.

With such a configuration, when changes in hydraulic head pressure are read from the pressure detection result, the occurrence of changes in pressure caused by other effects can be inhibited and changes in the hydraulic head pressure can be directly read.

The chemical supply system according to the seventh aspect of the invention is the chemical supply system according to any one of the first to sixth aspects of the invention. The pressure adjuster adjusts the pressure applied to the working chamber based on a difference between a set value of the suction pressure determined by the suction controller and an actual pressure detected by the pressure detector, for equalizing the actual pressure with the set pressure.

With such a configuration, the effect of hydraulic head pressure can be reduced by using the pressure detector that is used for feedback controlling the actual value of suction pressure to the set pressure. Therefore, the configuration can be simplified.

The chemical supply system according to the eighth aspect of the present invention provides a chemical supply system for supplying chemical solution from a chemical tank. The chemical supply system includes a chemical supply pump having a pump chamber and a working chamber, the pump chamber being configured to be loaded with chemical solution from the chemical tank, the working chamber being configured to be loaded with working gas, the pump chamber and the working chamber commonly having a volume-changing member configured to actuate the pump chamber to suction and discharge the chemical solution, the volume-changing member being actuated in response to a pressure of the working gas loaded in the working chamber; a pressure adjuster configured to suction the chemical solution into the pump chamber by setting the pressure of working gas to a suction pressure; a working amount detector configured to detect a working amount that is uniquely set with respect to a volume reduction amount of the working chamber when the chemical solution flows into the pump chamber, the working amount being detected in at least one of a flow passage of the working gas connected to the working chamber and the chemical supply pump; and a suction controller configured to control a suction pressure applied by the pressure adjuster to the working chamber, based on the detection result of the working amount detector.

With such a configuration, the set value of the suction pressure during suction of the chemical solution is determined on the basis of the working amount that is uniquely set with respect to the volume reduction amount of the working chamber, Therefore, the effect of hydraulic head pressure of the chemical tank can be taken into account in the set value of the suction pressure. Further, since the working amount detector for detecting the working amount is provided in the flow passage side of the working gas leading to the working chamber or in the chemical supply pump, no changes in configuration are required upstream or downstream of the chemical supply pump in the flow passage of the chemical solution. Further, the set value of the suction pressure for reducing the effect of hydraulic head pressure in the above-described manner can be determined, while conforming to the process in which suction of the chemical solution is performed.

The chemical supply system according to the ninth aspect of the present invention is the chemical supply system according to the eighth aspect of the present invention. The suction controller is configured to control a set value of the suction pressure adjusted by the pressure adjuster, for equalizing a determined numerical value with a reference value based on a difference between the determined numerical value and the reference value, the determined numerical value being determined from a detection results obtained with the working amount detector, the reference value being for equalizing a displacement speed of the volume-changing member with the reference displacement speed when the chemical solution is suctioned into the pump chamber.

With such a configuration, the set value of the hydraulic head pressure can be caused to follow the variation of the hydraulic head pressure of the chemical tank.

The chemical supply system according to the tenth aspect of the present invention is the chemical supply system according to the eighth or ninth aspect of the present invention, further including a switching controller having a suction-side opening-closing valve provided on the suction passage connected to the pump chamber. The switching controller is configured to control the suction-side opening-closing to the open state when the chemical solution is suctioned into the pump chamber and to the closed state when the position of the volume-changing member is a complete position where the suction of the chemical solution is completed, and the working amount detector has a position detector for detecting a position of the volume-changing member as the working amount, the working amount detector being used when the position of the volume-changing member is recognized as in the complete position in the switching controller.

With such a configuration, the effect of hydraulic head pressure can be reduced by using the position detector that is used for determining whether the suction operation has been completed. Therefore, the configuration can be simplified.

E. Variations

The present invention is not limited to the described contents of the aforementioned embodiments and may be carried out, for example, as described below.

In the first embodiment, it is possible to calculate an increase ratio of pressure after the suction valve 23 has been set to the open state and determine a set value of suction pressure by using the increase ratio, without using a peak value on the positive pressure side of the pressure sensor 52 in the case in which the set pressure of the working chamber 15 is the atmospheric pressure and the suction valve 23 is set to the open state. In this case, the set value of suction pressure can be rapidly determined and therefore the time required for the suction operation in each cycle can be reduced as a whole.

In the first embodiment, the detection pressure that is set to estimate the hydraulic head pressure on the basis of the detection result of the pressure sensor 52 is not limited to the atmospheric pressure and it is possible to use a predetermined positive pressure or a predetermined negative pressure, provided that the degree of change of the hydraulic head pressure following the change in the chemical solution amount in the chemical tank 27 can be read. However, when the detection pressure is set to the atmospheric pressure, setting of the detection pressure can be facilitated. In other words, in the case of configuration including a port for opening the electropneumatic regulator 30 to the atmosphere, a passage by which the port communicates with an output passage, and an electromagnetic opening-closing valve that opens and closes the passage, the detection pressure can be set by setting the electromagnetic opening-closing valve to the open state.

In the first embodiment, a configuration in which the operation of the chemical supply system is stopped when the estimated value of the hydraulic head pressure is equal to or less than a predetermined pressure may be used instead of the configuration in which the set value of suction pressure is changed according to the estimated value of the hydraulic head pressure.

The feature of opening the suction valve 23 in a state in which the pressure applied to the working chamber 15 is set to a detection pressure and obtaining the working amount for determining the set value of suction pressure by using the fact that the chemical solution flows into the pump chamber 14 +in this case under its own hydraulic head pressure, as in the first embodiment, may be applied to the configuration in which the actual displacement rate of the partition region 13*a* is obtained on the basis of the detection result of the position detection sensor 55, as in the second embodiment, or the configuration in which the actual displacement rate of the partition region 13*a* is obtained on the basis of the detection results of the flow rate sensor 71, as in the third embodiment.

In the second embodiment and the third embodiment, the set value of suction pressure may be changed intermittently so as to obtain stepwise changes, instead of changing the set value of suction pressure continuously in the course of the chemical solution suction operations. Further, the set value of suction pressure may be determined on the basis of the difference between the target value of volume change of the working chamber 15 and the actual value of volume change based on the detection result of the position detection sensor 55 or flow rate sensor 71, instead of determining the set value of suction pressure on the basis of the difference between the target displacement rate and actual displacement rate.

In each of the above-described embodiments, a period for holding the discharge electromagnetic valve 44 in the open state may be determined instead of determining the set value of suction pressure in the controller 60 or electropneumatic-side controller 72. However, the period for holding the discharge electromagnetic valve 44 in the open state corresponds to the suction pressure that will be set. Therefore, the set value of suction pressure is also determined in this configuration.

In each of the above-described embodiments, the chemical supply pump 10 is not limited to the configuration in which a negative pressure is applied during suction of the chemical solution and, for example, it is possible to provide an impelling means such as a spring for impelling the diaphragm 13 to a position close to the recess on the working chamber 15 side, apply a positive pressure to the working chamber 15 when the chemical solution is discharged and reduce the pressure in the working chamber 15 when the chemical solution is sucked. In this case, the set pressure that will be decreased may be also determined so as to reduce the effect of hydraulic head pressure of the chemical tank 27 as in the above-described embodiments. Further, the chemical supply pump 10 may be configured such that a positive pressure will be applied to the working chamber 15 both in the case in which the diaphragm 13 is displaced for discharging the chemical solution and in the case in which the diaphragm is displayed for suction of the chemical solution. In this case, the set value of positive pressure during suction of the chemical solution may be also determined so as to reduce the effect of hydraulic head pressure of the chemical tank 27 as in the above-described embodiments.

In the above-described embodiments, a method for determining the completion of suction of the chemical solution is not limited to the method using the position detection sensor 55 that detects the position of the partition region 13*a* and any method may be used. For example, it is possible to provide a switch that is switched ON when the partition region 13*a* of the diaphragm 13 is disposed in a suction completion position and to determine that the suction operation has been completed by confirming that the switch has been switched ON. Further, a configuration may be also used in which a suction operation time sufficient to complete the suction operation is determined in advance and the suction operation is determined to be completed when the suction operation time elapses since the start of the suction operation. With such a configuration in which the suction operation is managed by measuring time, the time required for suction is also made constant as in the above-described embodiments, thereby making it possible to complete the suction of the chemical solution before the suction operation time elapses. Even if, for any reason, the hydraulic head pressure drops more than predicted, the transition to the discharge operation in a state in which suction of the chemical solution is still incomplete can be prevented.

In the above-described embodiments, the volume-changing member provided in the chemical supply pump 10 is not limited to the diaphragm 13 and may be a bellows. Further, the electropneumatic regulator 30 is not limited to the configuration in which the vacuum generation source 36 is provided as a negative pressure generation source and may have, for example, a configuration in which an ejector is provided that generates a negative pressure by using compressed air supplied from the supply source 33. Further, the electropneumatic regulator 30 may be of a proportional control system.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A chemical supply system for supplying chemical solution provided from a chemical tank, comprising:

a chemical supply pump having a pump chamber and a working chamber, the pump chamber being configured to be loaded with chemical solution from the chemical tank, the working chamber being configured to be loaded with working gas, the pump chamber and the working chamber commonly having a volume-changing member configured to actuate the pump chamber to suction and discharge the chemical solution, the volume-changing member being actuated in response to a pressure of the working gas loaded in the working chamber;

a pressure adjuster configured to suction the chemical solution into the pump chamber by setting the pressure of working gas to a suction pressure;

a switching controller having a discharge-side opening-closing valve provided in a discharge passage connected to the pump chamber, a suction-side opening-closing valve provided in a suction passage connected to the pump chamber, wherein the switching controller is configured to switch the suction-side opening-closing valve to the open state for starting to fill the pump chamber with the chemical solution when the suction-side opening-closing valve and the discharge-side opening-closing valve are in closed state;

a pressure detector configured to detect at least one of a gas pressure in a space connected to the working chamber and a gas pressure in the working chamber when the suction-side opening-closing valve is switched to the open state and starts an inflow of the chemical solution to the pump chamber;

a suction controller configured to control the suction pressure applied to the working chamber by the pressure adjuster, based on a detection result of the pressure detector; and a position detector configured to detect a position of the volume-changing member, wherein the switching controller is further configured to control the suction-side opening-closing valve to switch from the open state to the closed state in response to a detection result of the position detector corresponding to a complete position of the volume-changing member, the complete position being for the volume-changing member to complete the suction, and wherein the suction controller is further configured to control the suction pressure applied to the working chamber by the pressure adjuster, for obtaining a constant time required for the position of the volume-changing member to move to the complete position in each suction operation.

2. The chemical supply system according to claim 1, wherein the suction controller is configured to set a lower set value of the suction pressure after the detection, a lower pressure being detected by the pressure detector.

3. The chemical supply system according to claim 1, wherein the pressure adjuster includes:

a first opening-closing valve configured to control on-off of the application of a discharge pressure to the working chamber; and a second opening-closing valve configured to control on-off of the application of the suction pressure to the working chamber, wherein the pressure adjuster is configured to close the first opening-closing valve and the second opening-closing valve, whereby the working chamber and a space connected with the working chamber are made closed spaces, till the detection of pressure by the pressure detector is completed for the pressure adjuster to determine a set value of the suction pressure by the suction controller.

4. The chemical supply system according to claim 1, further comprising a detection controller configured to set a pressure of the pressure adjuster to a detection pressure, the detection pressure being for enabling the pressure detector to detect a pressure change caused by a flow of the chemical solution into the pump chamber, the flow being made by the opening of the suction-side opening-closing valve when the discharge-side opening-closing valve and the suction-side opening-closing valve are in the closed state, wherein the suction controller is configured to control the suction pressure applied to the working chamber by the pressure adjuster based on a detection result of the pressure detector, the detection result being obtained when a flow of the chemical solution started by opening the suction-side opening-closing valve, wherein the pressure is set to the detection pressure before the opening of the suction-side opening-closing valve.

5. The chemical supply system according to claim 4, wherein the detection pressure is such that the chemical solution flows into the pump tank under a hydraulic head pressure of the chemical tank when the suction-side opening-closing valve is switched to the open state.

6. The chemical supply system according to claim 1, wherein the pressure adjuster adjusts the pressure applied to the working chamber based on a difference between a set value of the suction pressure determined by the suction controller and an actual pressure detected by the pressure detector, for equalizing the actual pressure with the set pressure.

* * * * *